US006663540B1

(12) United States Patent
Huang

(10) Patent No.: US 6,663,540 B1
(45) Date of Patent: Dec. 16, 2003

(54) TREADMILL WITH MASSAGING EFFECT

(76) Inventor: Ping-Hui Huang, No.23, 15th Road, Ta Li Industrial Park, Taiping City, Taichung Hsien (TW)

( * ) Notice: Subject to any disclaimer, the term of this patent is extended or adjusted under 35 U.S.C. 154(b) by 0 days.

(21) Appl. No.: 10/251,961

(22) Filed: Sep. 23, 2002

(51) Int. Cl.[7] ..... A63B 26/00; A61H 15/00
(52) U.S. Cl. ..... 482/54; 601/126
(58) Field of Search ..... 482/51, 54, 142, 482/79; 601/126, 122, 24, 27–32, 127

(56) References Cited

U.S. PATENT DOCUMENTS 4,509,510 A * 4/1985 Hook ..... 601/28
5,393,287 A * 2/1995 Papapaschalis ..... 482/142
5,474,521 A * 12/1995 Yang ..... 601/126
5,711,745 A * 1/1998 Yang ..... 482/54
6,010,432 A * 1/2000 Vawter ..... 482/54

* cited by examiner

*Primary Examiner*—Stephen R. Crow
(74) *Attorney, Agent, or Firm*—Rosenberg, Klein & Lee

(57) ABSTRACT

The present invention relates to an improved treadmill which includes a massaging body suitable for massaging the soles of the feet and mounted on a base plate between a tread frame. A wear-resistant film is interposed between the walking belt and the massaging body so as to prevent the massaging body from abrasion. Accordingly, the soles of the feet are stimulated to achieve massaging effect by means of the massaging body when the operator treads on the walking belt for walking or jogging exercise.

9 Claims, 5 Drawing Sheets

TREADMILL WITH MASSAGING EFFECT

BACKGROUND OF THE INVENTION

1. Field of the Invention

The present invention relates to a treadmill with massaging effect, and more particularly, to a treadmill on whose tread base a massaging body is formed to achieve cushioning and massaging effects.

2. Description of the Prior Art

With the change of the society type, modern people have more stress and less time to take exercise. As a result, the indoor fitness exercise has been widely accepted. The commercially available fitness equipment, no matter for use in fitness centers or at home, can reach the exercise effect in restricted room. A conventional treadmill disclosed in TW 420012 is provided with sole massager which is installed under the walking belt of the treadmill and fixed on both sides of the treadmill's frame. The treadmill's frame includes two cross bars between which a plurality of corresponding U-shaped grooves are extended for accommodating the massager. The massager includes a plurality of rollers passing through the U-shaped grooves. Besides, roller shafts lean against several torsion springs mounted on both cross bars. The torsion springs can support the downward force created by the sole during exercise session so as to reach the massaging effect.

However, the above-mentioned treadmill with massaging effect also has following problems when used:

1. Uncomfortable: Though the bottom side of the roller shaft of the treadmill's massager is provided with torsion springs, the rollers are made of hard metal. The direct impact upon the sole makes the operators uncomfortable or even painful after walking for a longer time.
2. Bad massaging effect: The above-mentioned massager is provided with several rollers whose circular surfaces are used to massage the sole of the operator in walking. However, the circular surfaces of rollers are so great that the sole can't be effectively massaged.
3. The legs are easily injured when the operator operates it for a longer time. The torsion springs are fitted to the bottom of the shaft at both ends of the rollers. Therefore, all rollers tilt when one end of all rollers is compressed. Accordingly, the thenars of the operators are inclined therewith. The ankles are more easily sprained when the operator walks in a manner of inclined soles of the feet, thereby leading to pains of exercise injuries.

SUMMARY OF THE INVENTION

It is a primary object of the present invention to provide a treadmill whose tread base is provided with rubber or wooden massaging nodules. Therefore, the massaging nodules can massage the soles of both feet, thereby achieving the massaging effect on the operator.

It is another object of the present invention to provide a treadmill which has elastic and cushioning effects to prevent the pains of the sole of the feet after walking on the treadmill for a long time.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
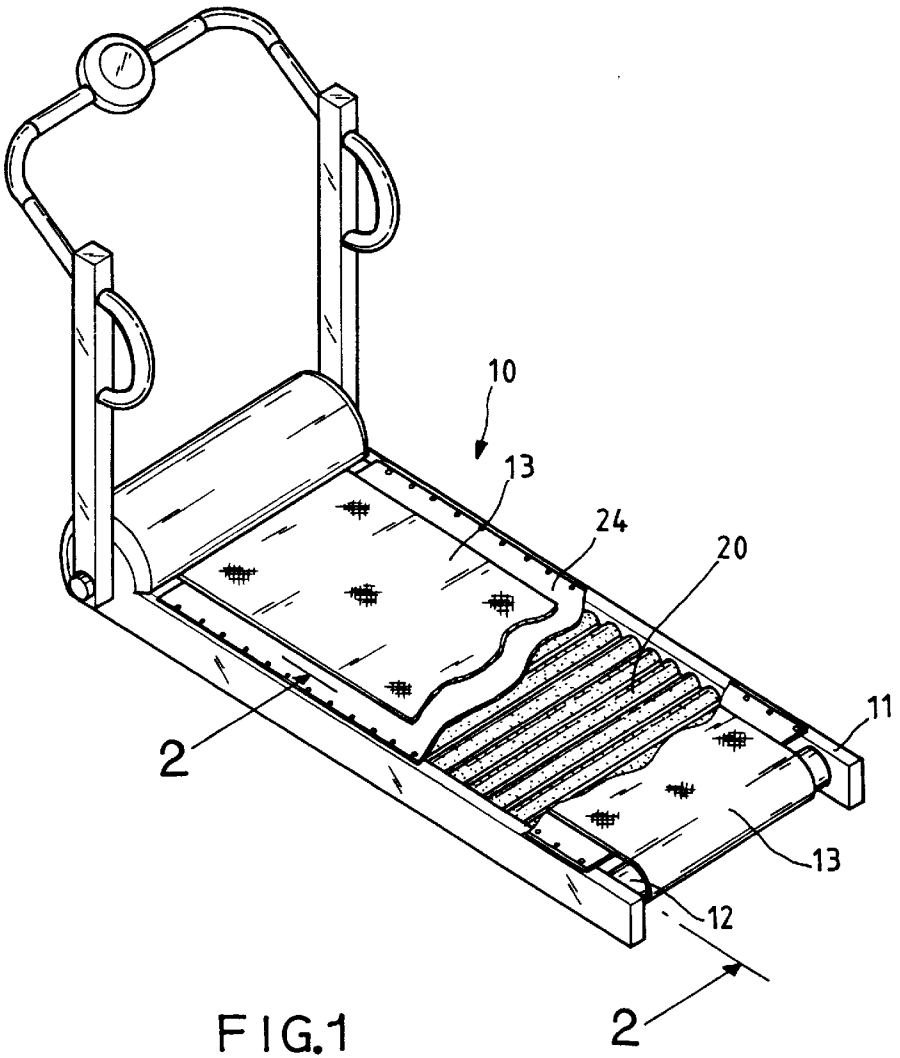
FIG. 1 is a perspective view of the present invention.
Figure 2:
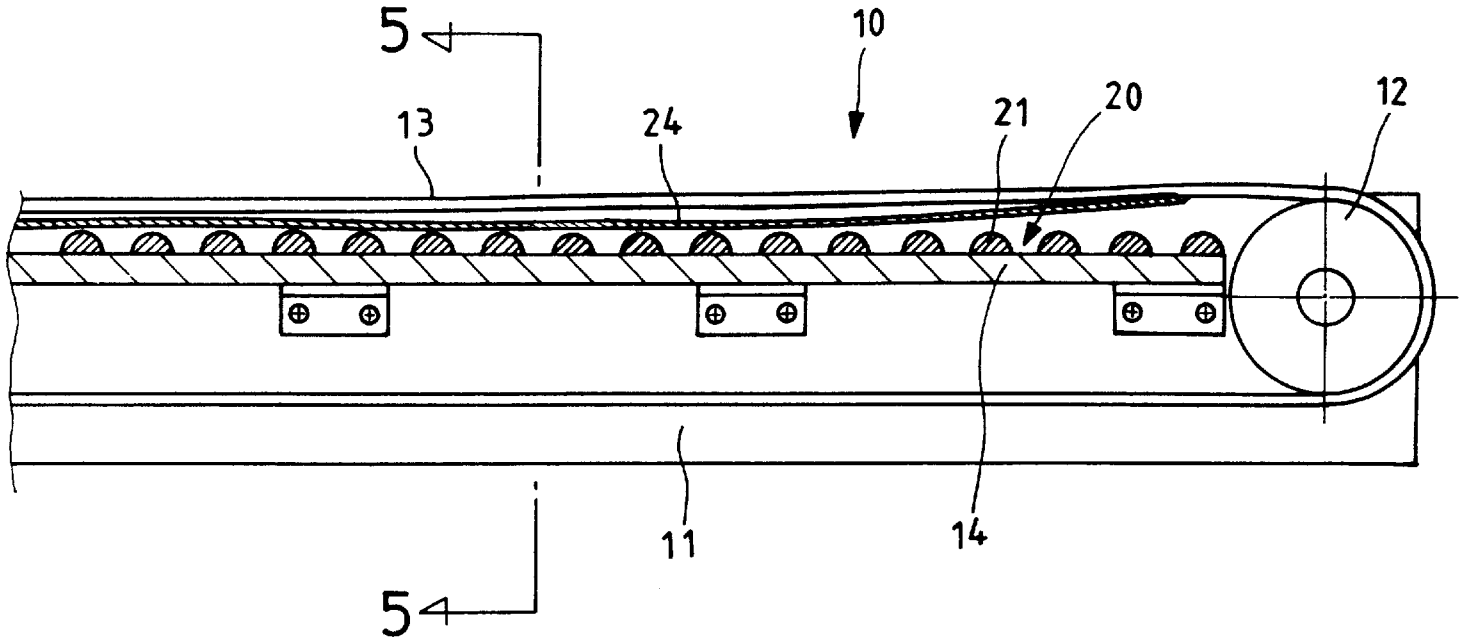
FIG. 2 is a sectional view of the present invention.

First of all, referring to FIGS. 1 and 2, an improvement of the treadmill of the present invention is shown. The treadmill in accordance with the present invention mainly includes a tread frame 10 having elongated bars 11 extended parallel to each other at both sides thereof. A base plate 14 is interposed between both elongated bars 11. A roller 12 is positioned between the respective ends of both elongated bars 11. A walking belt 13 is extended around both rollers 12 in such a way that the walking belt 13 is rotatably movable on the top of the base plate 14.

A massaging body 20, as shown in FIGS. 1 and 2, is mounted on the walking belt 13 and interposed between the top of the base plate 14 and the walking belt 13. A first embodiment of the massaging body 20 consists of massaging protrusion strips 21 stuck or screwed to the top of the base plate 14. Moreover, a film 24 made of wear-resistant material is positioned between the top of the massaging protrusion strips 21 and the walking belt 13. Meanwhile, both sides of the film 24 are fixed on the top of both elongated bars 11 of the tread frame 10.

Figure 5:
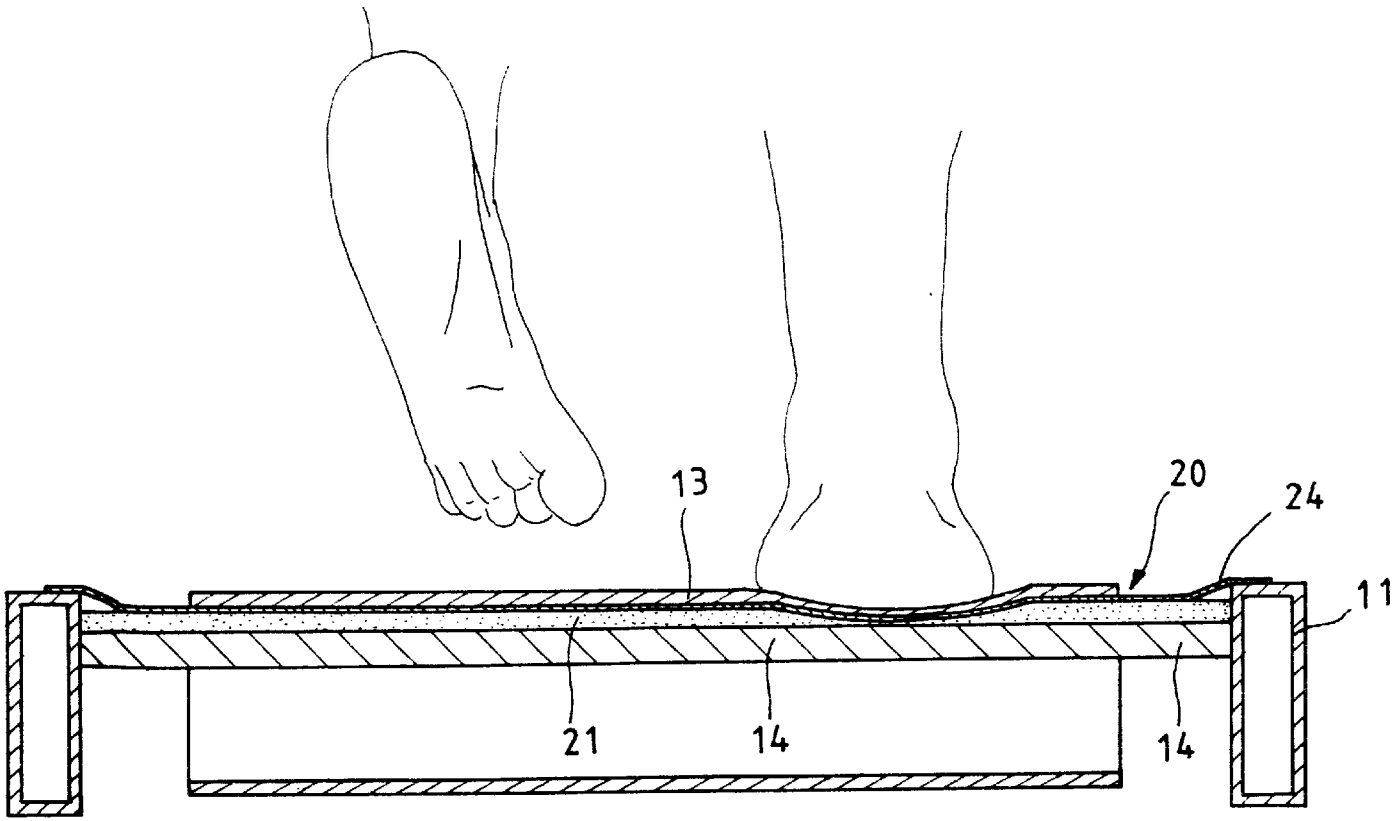
FIG. 5 is a schematic drawing of the present invention showing the cushioning massaging state.

Based on the assembly of the above-mentioned components, the base plate 14 of the present invention is provided with massaging body 20 formed by a plurality of massaging protrusion strips 21 on the top thereof. The wear-resistant film 24 is interposed between the massaging protrusion strips 21 and the walking belt 13 such that the soles of the operator's feet are in direct contact with the massaging protrusion strips 21 when treading on the walking belt 13 (see FIG. 5). The massaging protrusion strips 21 properly stimulate the soles, thereby achieving a comfortable massaging effect. Moreover, the massaging protrusion strips 21 can be made of rubber and wood material. When the operator treads on the walking belt 13, the massaging protrusion strips 21 made of rubber exert elastic and cushioning effect so that the soles won't receive direct impact. As a result, the injuries caused by walking or jogging for a longer time can be avoided. When the massaging protrusion strips 21 are made of wood material, the massaging effect thereof will be greater than that of rubber strips. Unlike the conventional metal rollers, it won't cause pain of the soles.

In addition, the wear-resistant film 24 is interposed between the massaging protrusion strips 21 and the walking belt 13. As a result, the walking belt 13 won't be in direct contact with the massaging protrusion strips 21 when the operator walks or jogs on the walking belt 13 and the walking belt 13 is continuously movable backwards. Accordingly, the massaging protrusion strips 21 won't be damaged because of wearing, thereby prolonging the life thereof.

Figure 3:
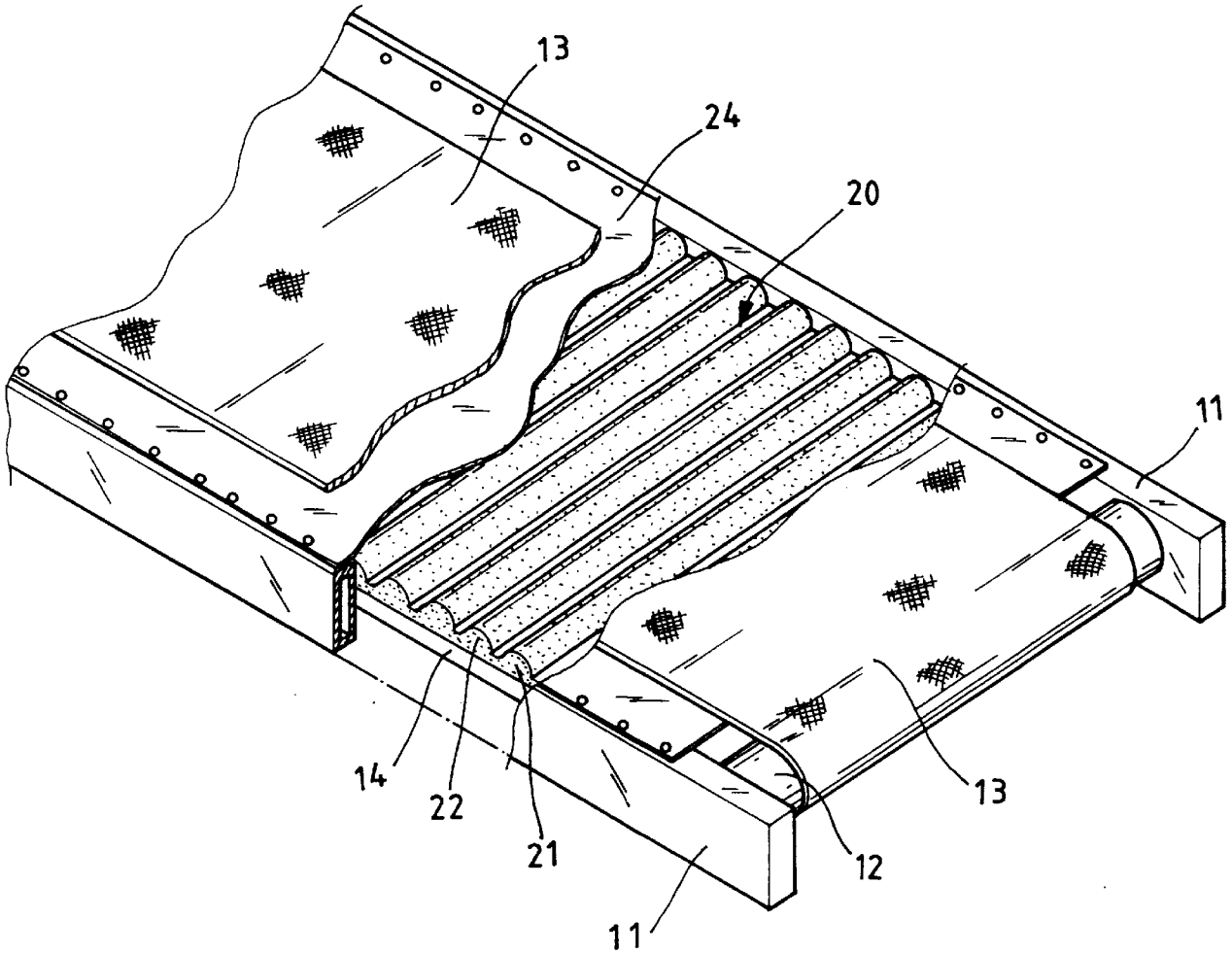
FIG. 3 is a perspective partial view of another embodiment of massaging body of the present invention.
Figure 4:
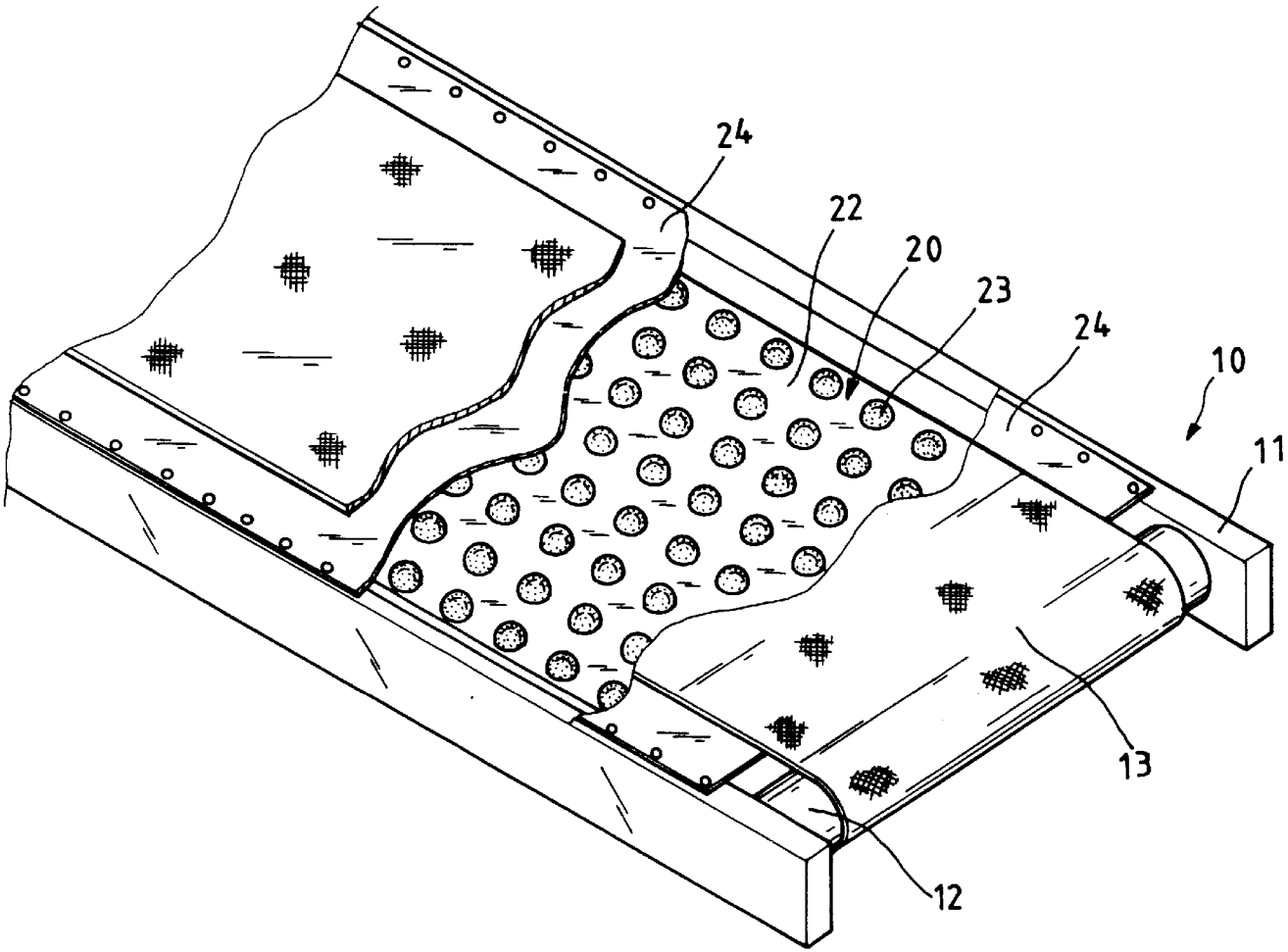
FIG. 4 is a perspective partial view of a further embodiment of massaging body of the present invention.

Furthermore, the massaging body 20 of the present invention can be constructed in such a way that a plurality of massaging protrusion strips 21, as shown in FIG. 3, are laterally extended on a mounting plate 22, or a plurality of massaging nodules 23, as shown in FIG. 4, are well-distributed thereon. The mounting plate 22 enhances the fixing effect of the massaging body 20 on the base plate 14, thereby achieving the convenience in assembly. The massaging nodules 23 arranged on the semicircular cavity 22 create different massaging effects on the soles of the feet of the operators.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill with massaging effect comprising:

a tread frame having elongated bars extended parallel to each other at both sides thereof;

a base plate interposed between both elongated bars, a roller being positioned between the respective end of both elongated bars;

a walking belt extended around both rollers in such a way that said walking belt is rotatably movable on the top of said base plate;

wherein a massaging body is provided on the top of said base plate and made of proper materials for massaging the soles of the feet, and wherein a plurality of protruding members are formed on the surface of said massaging body, and wherein a wear-resistant film is interposed between said walking belt and said massaging body;

so that the operator can enjoy the comfort produced by a cushioning and massaging effect on the soles of his feet when walking or jogging on said walking belt.

2. The treadmill with massaging effect as claimed in claim 1 wherein both sides of said wear-resistant film are fixed on said tread frame.

3. The treadmill with massaging effect as claimed in claim 1 wherein said massaging body is made of rubber.

4. The treadmill with massaging effect as claimed in claim 1 wherein said massaging body is made of wood material.

5. The treadmill with massaging effect as claimed in claim 1 wherein said massaging body consists of a plurality of massaging protrusion strips laterally extended between both elongated bars.

6. The treadmill with massaging effect as claimed in claim 1 wherein said massaging body is constructed in such a way that a plurality of massaging protrusion strips are laterally extended on a mounting plate.

7. The treadmill with massaging effect as claimed in claim 1 wherein the massaging body is constructed in such a way that a plurality of massaging nodules are well-distributed on said mounting plate.

8. The treadmill with massaging effect as claimed in claim 1 wherein said massaging body is directly stuck to said base plate.

9. The treadmill with massaging effect as claimed in claim 1 wherein said massaging body is screwed to said base plate.

* * * * *